US007497728B2

(12) United States Patent
Moskwa et al.

(10) Patent No.: US 7,497,728 B2
(45) Date of Patent: Mar. 3, 2009

(54) PANEL MOUNT ELECTRICAL CONNECTOR IN A BURNER ENCLOSURE APPARATUS AND METHOD

(75) Inventors: Kenneth R. Moskwa, Valparaiso, IN (US); Fred Hoffmaster, LaPorte, IN (US); Wayne Miller, Michigan City, IN (US)

(73) Assignee: SPX Corporation, Charlotte, NC (US)

( * ) Notice: Subject to any disclaimer, the term of this patent is extended or adjusted under 35 U.S.C. 154(b) by 463 days.

(21) Appl. No.: 11/237,774

(22) Filed: Sep. 29, 2005

(65) Prior Publication Data

US 2006/0199128 A1 Sep. 7, 2006

Related U.S. Application Data

(60) Provisional application No. 60/652,768, filed on Feb. 15, 2005.

(51) Int. Cl.
*H01R 13/60* (2006.01)

(52) U.S. Cl. ..... 439/577; 439/911; 439/919; 431/343

(58) Field of Classification Search ..... 439/577, 439/911, 919; 431/343, 258–266
See application file for complete search history.

(56) References Cited

U.S. PATENT DOCUMENTS

| | | | | |
|---|---|---|---|---|
| 4,740,156 | A * | 4/1988 | Beck et al. | 431/265 |
| 6,151,448 | A * | 11/2000 | Reusche et al. | 392/501 |
| 6,582,220 | B2 * | 6/2003 | Heck et al. | 431/258 |
| 6,886,756 | B2 * | 5/2005 | Rolph et al. | 236/25 A |
| 6,899,561 | B2 * | 5/2005 | Johann | 439/542 |

* cited by examiner

*Primary Examiner*—Gary F. Paumen
(74) *Attorney, Agent, or Firm*—Baker & Hostetler LLP

(57) ABSTRACT

A panel mount electrical connector in a burner enclosure panel includes an electrical connector receptacle mounted to an enclosure panel of a fuel-burning combustion device, an internal wiring harness, an electrical connector plug that matches the receptacle, and an external wiring harness configured to be coupled to a separate appliance. The panel mount electrical connector facilitates easy and quick disconnection of the burner electrical wiring at the burner enclosure panel, making installation, removal, and maintenance less difficult.

16 Claims, 5 Drawing Sheets

PANEL MOUNT ELECTRICAL CONNECTOR IN A BURNER ENCLOSURE APPARATUS AND METHOD

CROSS-REFERENCE TO RELATED APPLICATIONS

This application claims priority to provisional U.S. patent application entitled, Panel Mount Electrical Disconnect in a Burner Enclosure Apparatus and Method, filed Feb. 15, 2005, having a Ser. No. 60/652,768, the disclosure of which is hereby incorporated by reference in its entirety.

FIELD OF THE INVENTION

The present invention relates generally to fuel-burning combustion devices. More particularly, the present invention relates to electrical connections between component fuel-burning combustion devices and related appliances.

BACKGROUND OF THE INVENTION

Fuel-burning combustion devices, or burners, are used in a variety of general heating applications. For example, burners are used in conjunction with boilers, furnaces, water heaters and steam generators. In addition, a wide selection of burners are available that use various types of fuel. For example, burners are configured to operate with different types of combustible materials, such as fuel oil, petroleum, kerosene, diesel fuel, and natural or propane gas.

While some burners are integral to another appliance, such as a boiler, furnace or water heater, other burners are designed as an independent unit that forms a component of a system when coupled with a separate appliance. In the case of a component burner, an electrical link typically is required between the burner and an appliance to provide electrical power or communicate control signals. The electrical link generally includes one or more wires, which may be grouped together to form a wiring harness, coupled to the burner and to the appliance. The wire or wiring harness also can be enclosed in a protective conduit.

However, the wire or wiring harness of some existing burner configurations can be cumbersome, interfering with access to the burner and making installation, removal and maintenance difficult. Accordingly, it is desirable to provide a method and apparatus that allow electrical coupling between a component burner and a related appliance and improve accessibility of the burner.

SUMMARY OF THE INVENTION

The foregoing needs are met, to a great extent, by the present invention, wherein in one aspect an apparatus and method are provided that in some embodiments provide for electrical coupling between a component burner and a related appliance and improve accessibility of the burner.

In accordance with one aspect of the present invention, an electrical connector mounted to a fuel-burning combustion device enclosure includes a panel configured to form at least a partial enclosure of a fuel-burning combustion device, and an electrical connector mounted to the panel.

In accordance with another aspect of the present invention, a fuel-burning combustion device includes a burner assembly configured to supply heat to an appliance. The device also includes a panel configured to form at least a partial enclosure of the burner assembly, and an electrical connector mounted to the panel.

In accordance with yet another aspect of the present invention, an electrical connector mounted to a fuel-burning combustion device enclosure includes means for at least partially enclosing a fuel-burning combustion device, and means for coupling an electrical circuit mounted to the means for enclosing.

In accordance with still another aspect of the present invention, a method of coupling an electrical circuit near a face of a fuel-burning combustion device enclosure includes providing an opening in a panel that is configured to form at least a partial enclosure of a fuel-burning combustion device, and mounting an electrical connector in the opening.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Fuel-burning combustion devices, or burners, often form a component of a system that includes another appliance, such as a boiler, a furnace, a water heater, or a steam generator. Throughout this disclosure, the term "component burner" is used to designate a burner that is used in conjunction with an appliance as a component of a heating system. Similarly, the term "separate appliance" is used throughout this disclosure to designate an appliance that is used in conjunction with a burner. Although the word "separate" is used, it should be understood that in operation the burner typically is fastened to the appliance.

An embodiment of the present invention is configured to be compatible with residential-type fuel oil burners. However, other embodiments can be configured to be compatible with any suitable fuel-burning combustion device, burner, or combustor, including devices that operate with different types of combustible materials, or fuels, such as petroleum, kerosene, diesel fuel, alcohol, gasoline, natural gas, propane gas, pulverized coal, or waste products (e.g., wood waste or waste lubricant oils). Similarly, alternative embodiments can be configured to be compatible with commercial burners.

Figure 1:
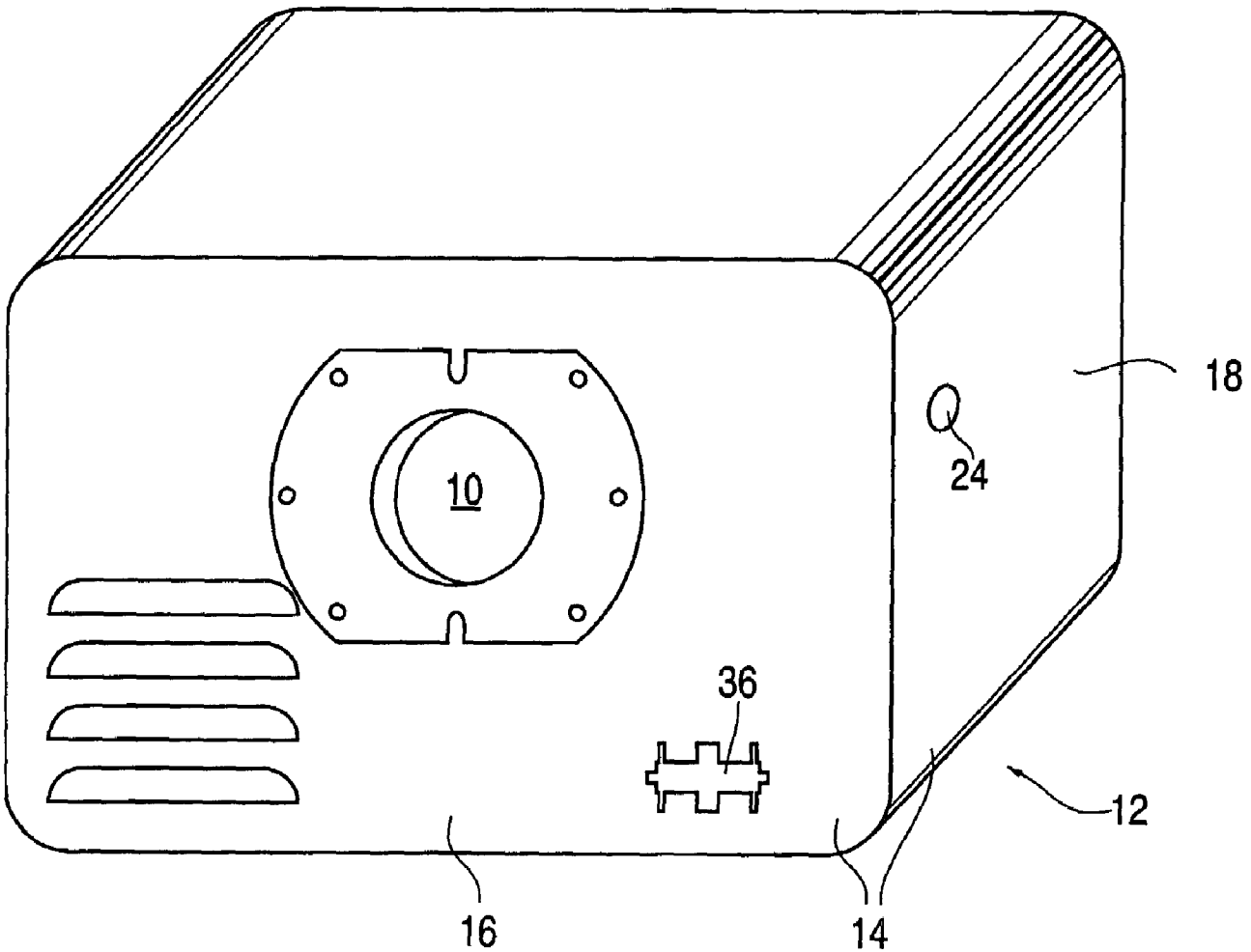
FIG. 1 is an exterior perspective view of a fuel burning combustion device enclosure.

The invention will now be described with reference to the drawing figures, in which like reference numerals refer to like parts throughout. FIG. 1 shows a burner assembly, or burner 10, which can include an enclosure 12 with one or more external enclosure panels 14 that cover or enclose part or all of the burner assembly 10. For example, a burner 10 may include a rigidly attached, or stationary, front panel 16 and a removable cover panel 18 that attaches to the stationary front panel 16. In this case, the removable cover panel 18 can include five side surfaces, or walls, and one open side. The example cover panel 18 can be installed on the burner 10 such that the edges of the cover panel 18 walls adjacent to the open side meet the front panel 16 so as to create a substantially cubicle, full enclosure around the burner 10. Nevertheless, other embodiments include any suitable enclosure, which may include any number of surfaces of any shape.

Figure 2:
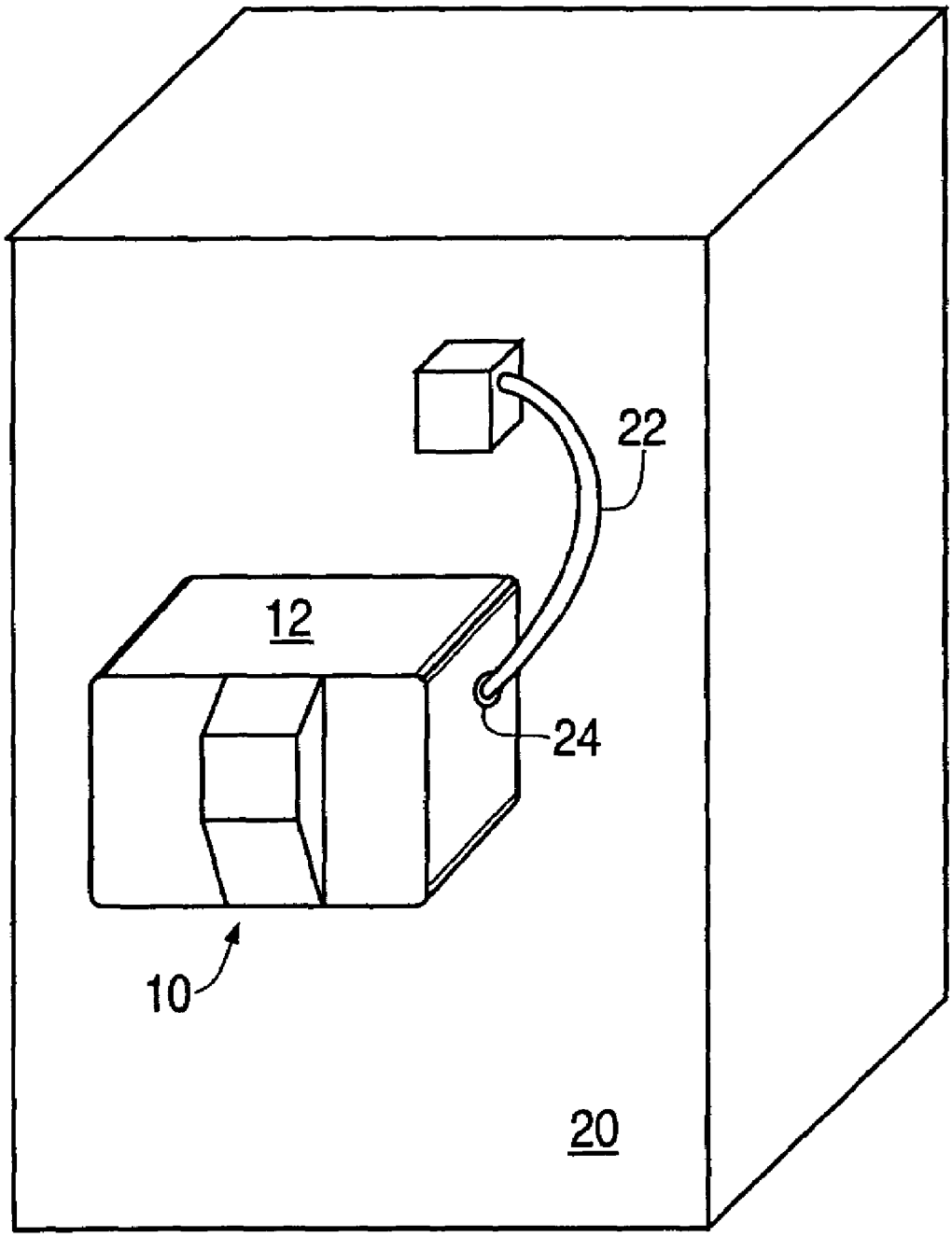
FIG. 2 is a perspective view of a component burner assembly and a separate appliance.

Typically, a component burner 10 is electrically linked, or interconnected, to a separate appliance 20 in order to receive power, as shown in FIG. 2. The component burner 10 may also be linked to the separate appliance 20 in order to communicate control signals between the component burner 10 and the separate appliance 20. The electrical link, or links, generally include one or more wires, which may be grouped together to form a wiring harness 22 coupled to the component burner 10 and to the appliance 20.

In a burner assembly configuration that includes an enclosure 12, the wiring harness 22 exits the enclosure 12 in order to be routed to a separate appliance 20. Thus, the enclosure 12 can include a slot or hole 24 through which the wiring harness 22 can pass. In addition, a component burner 10 can include an unsupported inline electrical connector, including a receptacle and a plug, incorporated into a wiring harness 22 configured to electrically couple the component burner 10 to the separate appliance 20. However, the wiring harness 22 may interfere with removal of the cover panel 18; this can become more problematic when the burner 10 is attached to the separate appliance 20. Furthermore, the wiring harness 22 may interfere with installation of the burner 10 on and removal of the burner 10 from the separate appliance 20.

Figure 3:
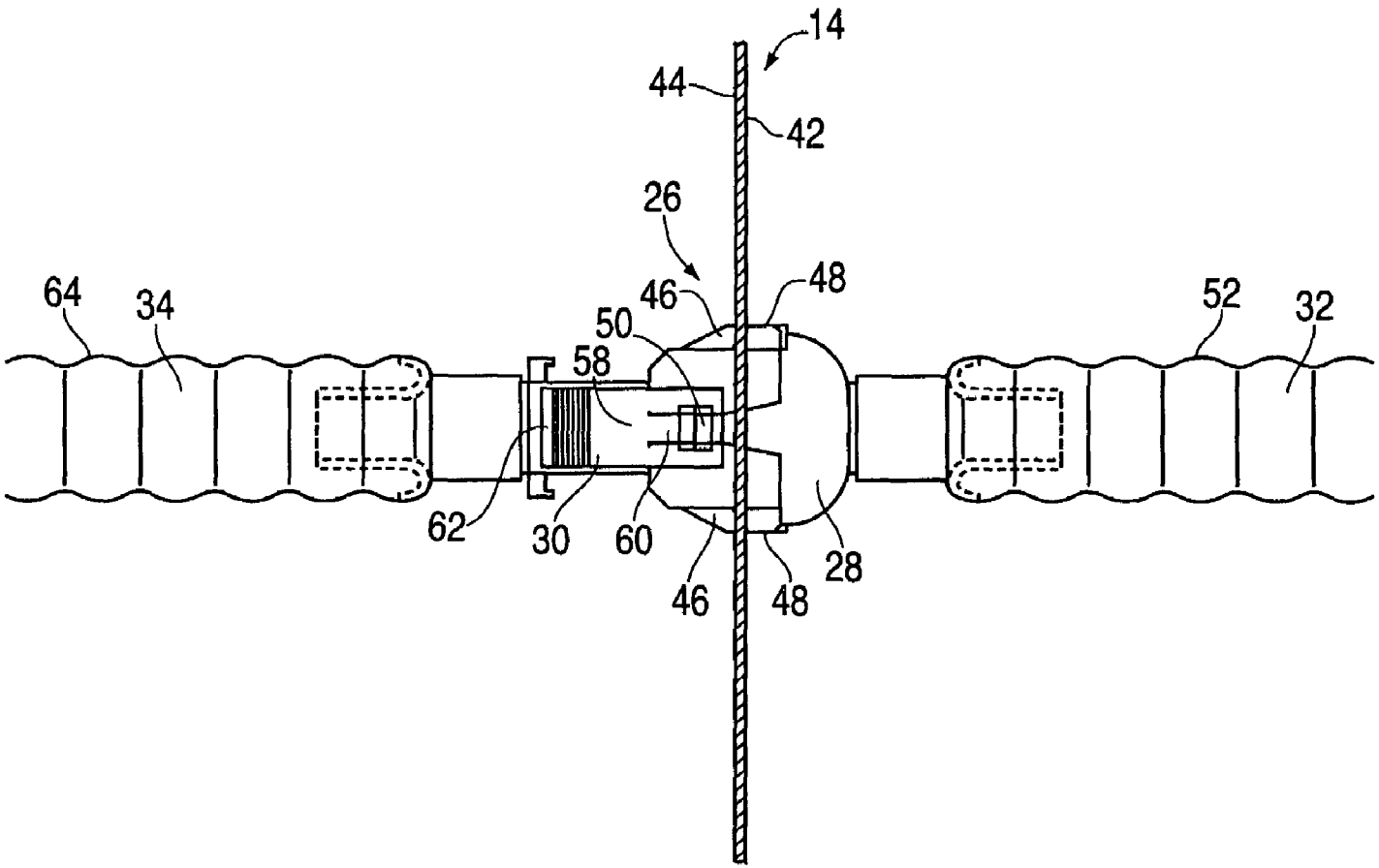
FIG. 3 is a side view of a panel mount electrical connector mounted to a burner enclosure panel according to an embodiment of the present inventive apparatus and method.

In order to circumvent these difficulties, an embodiment in accordance with the present inventive apparatus and method, shown in FIG. 3, provides a panel mount electrical connector 26 in a burner enclosure panel 14, which can include an electrical connector receptacle 28 and plug 30, an internal wiring harness 32 and an external wiring harness 34. The electrical connector receptacle 28 or the electrical connector plug 30 can be installed in a burner enclosure panel opening, or cutout 36 (shown in FIG. 1). Thus, the wiring harness can be disconnected at the burner enclosure panel 14, allowing ready access to the burner 10. As a result, this configuration provides improved accessibility of the burner 10, as compared to some existing burner configurations, making installation, removal and maintenance of the burner 10 less difficult.

Figure 4:
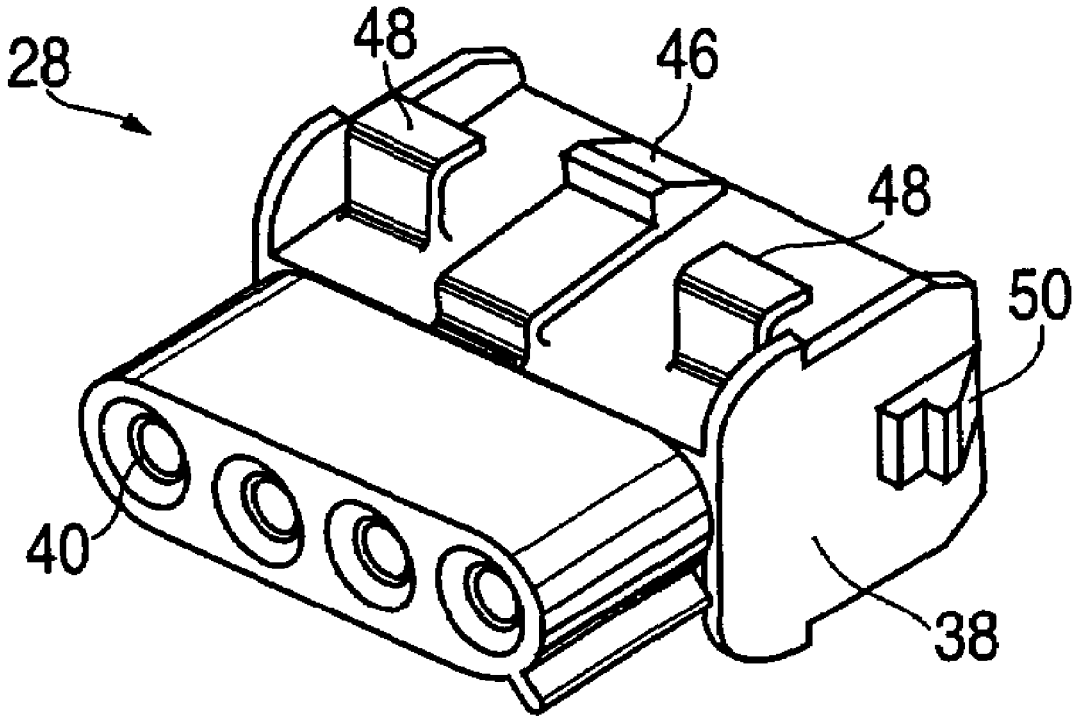
FIG. 4 is a perspective view of an electrical connector receptacle suitable for use with the panel mount electrical connector of FIG. 3.

An embodiment of the panel mount electrical connector 26 can include an electrical connector receptacle, including a receptacle casing, or shell, and receptacle terminals, or socket contacts. An exemplary electrical connector receptacle 28 suitable for use with the panel mount electrical connector 26 is shown in FIG. 4. The exemplary electrical connector receptacle 28 includes a plastic receptacle casing 38 mounted in an opening, or cutout, 36 (shown in FIG. 1) in a burner enclosure panel 14, and four socket contacts 40 installed in the receptacle casing 38. The exemplary receptacle 28 has a generally rectangular shape; it will be appreciated, however, that the receptacle 28 can take other forms, including a round, square, or elliptical shape. Similarly, it will be appreciated that other embodiments of the receptacle casing 38 may include any suitable material, such as a metal, a nonmetallic material including a composite thermoplastic or porcelain, or the like.

Exemplary electrical terminals, or socket contacts 40, are shown in FIG. 4. The socket contacts 40 provide electrical terminals for electrically coupling the receptacle 28 to a matching electrical connector plug 30 (see FIG. 3). Although the exemplary electrical connector receptacle 28 includes four socket contacts 40, other embodiments may include any suitable number of socket contacts 40, or other electrical terminals in accordance with the wiring requirements of the burner 10 and separate appliance 20 (shown in FIG. 2). Although the exemplary socket contacts 40 shown in FIG. 4 include a round cross section, it will be appreciated that other embodiments may include electrical terminals of any suitable shape or cross section, such as a square cross section, flat (tongue-shaped) cross section, or the like. Examples of receptacle casings 38 and socket contacts 40 that are suitable for use with the present inventive apparatus and method include the AMP part numbers 1-480703-0 and 350536-1, manufactured by Tyco Electronics of Harrisburg, Pa., USA; and the Molex part numbers 50-84-2040 and 02-08-1001, manufactured by Molex, Inc. of Lisle, Ill., USA.

Referring again to FIG. 1, in a preferred embodiment, the burner enclosure panel 14 is a stationary panel stamped from a metal sheet and rigidly attached to the burner 10. The cutout 36 is an open space defined by the remaining walls of the burner enclosure panel 14 after an area of the panel is cut, punched or trimmed away. The cutout 36 can be cut, punched or trimmed to form an opening generally conforming to the shape of the external cross section of an electrical connector receptacle, such as the exemplary receptacle 28 shown in FIG. 4, such that the receptacle can be inserted into the cutout 36 from one side of the panel 14. In other embodiments, the cutout 36 may take any suitable form to conform to the shape of a particular receptacle. In a preferred embodiment of the invention, the receptacle 28 is inserted into the burner enclosure panel cutout 36 from the direction of the inner surface 42 of the panel (shown in FIG. 3). In other embodiments the receptacle 28 is inserted into the burner enclosure panel 14 from the direction of the outer surface 44 of the enclosure panel 14.

The receptacle casing 38 shown in FIG. 4 can include a clamping mechanism to attach the receptacle 28 to the burner enclosure panel 14 (see FIG. 3). For example, the exemplary receptacle casing 38 of FIG. 4 includes cantilevered appendages, or "tongues," 46 on the upper and lower surfaces of the receptacle 28. The cantilevered appendages 46 extend parallel to the upper and lower surfaces of the receptacle 28 and include a wedge-shaped cross section near the tip of each of the cantilevers 46. A preferred embodiment includes one cantilevered appendage 46 on the upper surface of the receptacle 28 and one cantilevered appendage on the lower surface of the receptacle 28.

As further shown in FIG. 4, the exemplary receptacle 28 includes appendages, or "ears," 48 of "L"-shaped cross section on an upper surface and on a lower surface of the receptacle 28. A preferred embodiment includes two appendages 48 on the upper surface and two appendages 48 on the lower surface, for a total of four "L"-shaped cross section appendages 48. As shown in FIG. 3, a tip of each of the ears 48 contacts the inner surface 42 of the burner enclosure panel 14 when the receptacle 28 is inserted into the cutout 36 (see FIG. 1) from the direction of the inner side 42 of the burner enclosure panel 14, providing a flexible "stop" to correctly position the receptacle 28 with respect to the burner enclosure panel 14.

When the receptacle 28 is inserted into the burner enclosure panel 14, as shown in FIG. 3, the wedge-shaped tips of the cantilevered appendages 46 contact the panel wall upper and lower edges, depressing the tongues 46 so the receptacle 28 is able to extend through the cutout 36 (shown in FIG. 1). When the wedge-shaped tips of the tongues 46 pass fully through the cutout 36 opening, the tongues 46 snap outward, clamping the burner enclosure panel walls between the tips of the "L"-shaped appendages 48 and the wedge-shaped tips of the cantilevered appendages 46, as shown in FIG. 3, in order to effectively pin, or clamp, the receptacle 28 into place. Although the exemplary receptacle 28 includes a clamping mechanism comprising ears 48 and tongues 46, other embodiments may include any suitable clamping or attachment mechanism, including a threaded casing and backface, or fasteners, such as screws, rivets or pins, adhesive, or the like.

In addition, the receptacle 28 can include an interlock mechanism to latch the electrical connector receptacle 28 to a complementary electrical connector plug 30. For example, a preferred embodiment includes wedge-shaped protrusions 50, as shown in FIG. 4, on a right surface and on a left surface of the receptacle casing 38. The wedge-shaped protrusions 50 are configured to interface with and engage matching cantilever-shaped appendages 48 on a mating electrical connector plug 30, as shown in FIG. 3, in order to latch, or hold, the electrical connector plug 30 snugly in position against the electrical connector receptacle 28. However, in other embodiments the locking mechanism can take any of numerous forms known in the art.

FIG. 3 also shows an internal wiring harness 32, which can be coupled to an internal burner junction box or other electrical connection internal to the burner 10 (see FIG. 2) and to an interior interface of the socket contacts 40 (shown in FIG. 4) in the receptacle casing 38 toward the inner side 42 of the burner enclosure panel 14. The exemplary internal wiring harness 32 shown in FIG. 3 includes four electrical conductors, or wires. However, it will be appreciated that in other embodiments the internal wiring harness 32 may include any suitable number of wires in accordance with the wiring requirements of the burner 10 and separate appliance 20 (see FIG. 2).

In a preferred embodiment, the internal wiring harness 32 is enclosed in a protective sleeve, or conduit 52, such as the exemplary flexible metal conduit 52 shown in FIG. 3. The conduit 52 can be affixed to the receptacle casing 38 (see FIG. 4) to provide stress relief, and the wire or individual wires of the internal wiring harness 32 can be coupled to the socket contacts 40 (see FIG. 4) in the receptacle 28. In addition, other embodiments may include any suitable protective conduit 52 on the internal wiring harness 32, such as a nonmetallic conduit or a plastic conduit. Furthermore, an alternative embodiment does not include a protective conduit on the internal wiring harness 32.

Figure 5:
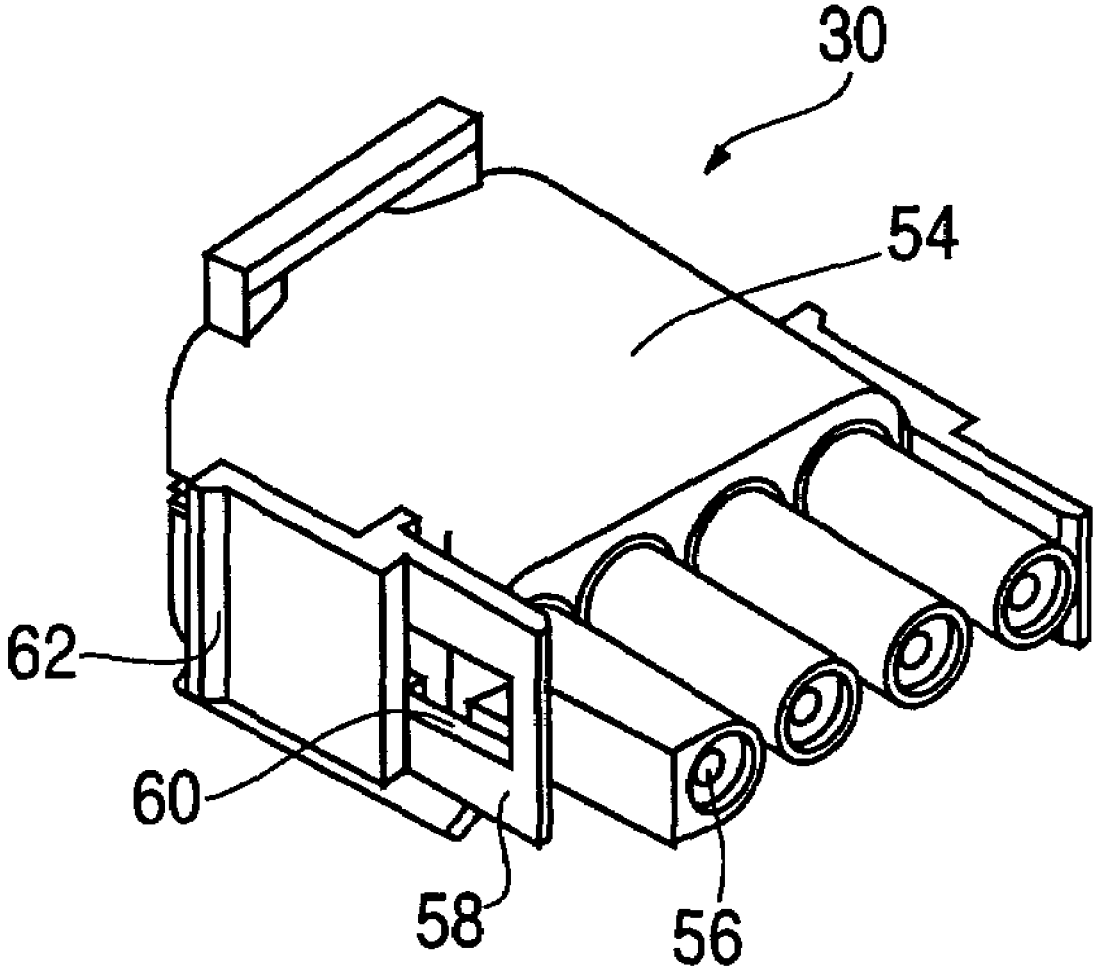
FIG. 5 is a perspective view of an electrical connector plug suitable for use with the panel mount electrical connector of FIG. 3.

An embodiment of the present invention can also include an electrical connector plug, including a plug casing, or shell, and electrical terminals, or pin contacts. An exemplary electrical connector plug 30 suitable for use with the panel mount electrical connector 26 is shown in FIG. 5, including a plug casing 54 and pin contacts 56. The exemplary electrical connector plug 30 includes a plastic plug casing 54 configured to match or mate with the receptacle casing 38 (shown in FIG. 4), the shape of the exterior of the plug casing 54 generally conforming to the shape of the interior of the receptacle casing 38. The exemplary plug 30 has a generally rectangular shape; it will be appreciated, however, that the plug 30 can take other forms, including a round, square, or elliptical shape, in accordance with the shape of the complementary electrical connector receptacle 28 (see FIG. 4). Similarly, it will be appreciated that other embodiments of the plug casing 54 may include any suitable material, such as a metal, a nonmetallic material, porcelain, or the like.

In various embodiments, one or more pin contacts 56 can be installed in the plug casing 54 to provide for electrical coupling to a mating electrical connector receptacle 28, such as that shown in FIG. 4. For example, four pin contacts can be installed, two of which can be configured to carry split-phase alternating current, one of which can be configured as a "common" alternating current return, and one of which can be configured as a device frame ground circuit. Although four pin contacts 56 are shown in the exemplary embodiment of FIG. 5, other embodiments may include any suitable number of pin contacts 56, or other electrical terminals in accordance with the wiring requirements of the burner 10 and separate appliance 20 (see FIG. 2). The pin contacts 56 are configured to receive mating, or matched, socket contacts 40 of a complementary electrical connector receptacle, such as the exemplary mating electrical connector receptacle 28 shown in FIG. 4. Although the exemplary pin contacts 56 shown in FIG. 5 include a round cross section, it will be appreciated that other embodiments may include electrical terminals of any suitable shape or cross section, such as a square cross section, flat (tongue-shaped) cross section, or the like.

In addition, the plug 30 can include an interlock mechanism to latch the electrical connector plug 30 to a complementary electrical connector receptacle. For example, the exemplary plug 30 of FIG. 5 includes cantilever-shaped lever arms 58 on a right surface and on a left surface of the plug casing 54. The cantilever-shaped lever arms 58 include cutout areas 60 configured to interface with and engage matching wedge-shaped protrusions 50 (see FIG. 4) on a complementary electrical connector receptacle 28 in order to latch, or hold, the electrical connector plug 30 snugly in position against the electrical connector receptacle 28. When the plug 30 is inserted into the receptacle 28, as shown in FIG. 3, the cantilever-shaped lever arms 58 bend away from the surfaces of the plug casing 54 to allow the wedge-shaped protrusions 50 of the receptacle casing 38 to slide under the cantilever-shaped lever arms 58. The lever arms 58 snap into place when the protrusions 50 align with the cutouts 60, and the lever arms 58 engage the protrusions 50. The lever arm ends 62 opposite the cutout areas 60 can be pressed inward to release the interlock mechanism and separate the plug 30 and receptacle 28. However, it will be appreciated that in other embodiments the locking mechanism can take any of numerous forms known in the art.

The panel mount electrical connector 26 also can include an external wiring harness configured to be coupled to a separate appliance 20 (see FIG. 2). An exemplary external wiring harness 34 is shown in FIG. 3. The external wiring harness 34 can be connected to an interface of the pin contacts 56 (see FIG. 5) in the plug 28 facing away from the outer surface 44 of the burner enclosure panel 14 in order to provide for electrical coupling between a component burner 10 and a separate appliance 20 (see FIG. 2), including an electrical connector at the burner enclosure panel 14. The exemplary external wiring harness 34 includes four electrical conductors, or wires. However, it will be appreciated that in other embodiments the external wiring harness 34 may include any suitable number of wires in accordance with the wiring requirements of the burner 10 and separate appliance 20.

In a preferred embodiment, the external wiring harness 34 is enclosed in a protective sleeve or conduit, such as the exemplary flexible metal conduit 64 shown in FIG. 3. The exemplary conduit 64 can be affixed to the plug casing 54 (see FIG. 5) to provide stress relief, and the wire or individual wires of the external wiring harness 34 can be coupled to the pin contacts 56 (see FIG. 5). In addition, other embodiments include any suitable protective conduit on the external wiring harness 34, such as a nonmetallic conduit or a plastic conduit. Furthermore, an alternative embodiment does not include a protective conduit on the external wiring harness 34.

Although the exemplary electrical connector receptacle 28 of FIG. 3 includes a clamping or attachment mechanism to provide for mounting the receptacle 28 in the burner enclosure panel 14, it will be appreciated that in an alternative embodiment the electrical connector plug 30 can instead include the ears 48 and tongues 46 (see FIG. 4), or another suitable configuration to attach or mount the electrical connector plug 30 in the burner enclosure panel 14. In this alternative embodiment, the electrical connector receptacle 28 does not include a clamping or attachment mechanism to attach to the panel 14, but rather, includes only a locking mechanism, such as the cantilevered lever arms 58 (see FIG. 5), to hold the receptacle 28 snugly against the electrical connector plug 30.

In operation, the electrical connector plug 30 (or the receptacle 28, in an alternative embodiment) can be easily and quickly disconnected from the electrical connector receptacle 28 (or plug 30, in an alternative embodiment), providing a convenient electrical connector 26 at or near the outer surface 44 of a burner enclosure panel 14. Thus, referring again to FIG. 2, the electrical link, or wiring harness 22, between a component burner 10 and a separate appliance 20 can be readily disconnected and moved away from the burner 10, allowing ready access to the burner 10, and making installation, removal, and maintenance of the burner 10 less difficult.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electrical connector system, comprising:

an electrical connector receptacle, including:

a receptacle casing having an upper surface, a lower surface, and two side surfaces, the upper surface having a cantilevered appendage extending parallel to the upper surface of the receptacle and a wedge-shaped cross section near an end of the cantilevered appendage, adapted to attach the receptacle to a panel, and an "L"-shaped tab extending from the upper surface of the receptacle casing, the tab having a tip, which contacts an inner surface of the panel when the receptacle is engaged with the panel, the two side surfaces each having a wedge-shaped protrusion, and at least four electrical conductors, each providing electrical terminals for coupling; and an electrical connector plug, including:

a plug casing having an upper surface, a lower surface, and two side surfaces, the two side surfaces each having cantilever-shaped lever arms including cutout areas configured to interface with, and engage, respective wedge-shaped receptacle protrusions and at least four electrical terminals, wherein the plug is configured to mate with the electrical connector receptacle.

2. The electrical connector system of claim 1, wherein the connector is configured to couple a fuel-burning combustion device to a related appliance.

3. The electrical connector system of claim 1, wherein the connector is configured to convey electrical power supply current between a fuel-burning combustion device and a related appliance.

4. The electrical connector system of claim 1, wherein the connector is configured to transmit an electrical control signal between a fuel-burning combustion device and a related appliance.

5. The electrical connector system of claim 1, wherein the receptacle is attached to the panel, and the plug is configured to be coupled to the receptacle.

6. The electrical connector system of claim 1, wherein the plug is attached to the panel, and the receptacle is configured to be coupled to the plug.

7. The electrical connector system of claim 1, wherein the receptacle and the plug are configured to engage one another, interlocking the electrical connector in order to impede unintentional decoupling of the receptacle and the plug.

8. The electrical connector system of claim 1, wherein the receptacle is configured to facilitate electrical connection with the plug.

9. The electrical connector system of claim 1, wherein the plug is configured to facilitate electrical connection with the receptacle.

10. The electrical connector system of claim 1, further comprising an internal wiring harness including at least an electrical conductor coupled to the connector and configured to be connected to the fuel-burning combustion device.

11. The electrical connector system of claim 10, wherein the internal wiring harness includes a protective external sleeve or conduit.

12. The electrical connector system of claim 1, further comprising an external wiring harness including at least an electrical conductor coupled to the connector and configured to be coupled to an appliance.

13. The electrical connector system of claim 12, wherein the external wiring harness includes a protective external sleeve or conduit.

14. The electrical connector system of claim 1, wherein the connector includes a plastic casing.

15. The electrical connector system of claim 1, wherein the connector includes a metal casing.

16. The electrical connector system of claim 1, wherein the connector includes a composite thermoplastic casing.

* * * * *